US010408218B2

(12) United States Patent
Kobayashi

(10) Patent No.: US 10,408,218 B2
(45) Date of Patent: Sep. 10, 2019

(54) FAN WITH SHUT-OFF VALVE AND METHOD OF OPERATING

(71) Applicant: GE AVIATION SYSTEMS, LLC, Grand Rapids, MI (US)

(72) Inventor: Sukeyuki Kobayashi, Loves Park, IL (US)

(73) Assignee: GE Aviation Systems LLC, Grand Rapids, MI (US)

( * ) Notice: Subject to any disclaimer, the term of this patent is extended or adjusted under 35 U.S.C. 154(b) by 341 days.

(21) Appl. No.: 15/357,466

(22) Filed: Nov. 21, 2016

(65) Prior Publication Data

US 2018/0142692 A1 May 24, 2018

(51) Int. Cl.

| | |
|---|---|
| ***F04D 27/00*** | (2006.01) |
| ***F04D 29/52*** | (2006.01) |
| ***F04D 19/00*** | (2006.01) |
| ***F04D 29/56*** | (2006.01) |
| ***F04D 25/08*** | (2006.01) |
| ***F04D 25/14*** | (2006.01) |

(52) U.S. Cl.

CPC ..... *F04D 27/002* (2013.01); *F04D 19/002* (2013.01); *F04D 25/08* (2013.01); *F04D 25/14* (2013.01); *F04D 29/522* (2013.01); *F04D 29/524* (2013.01); *F04D 29/563* (2013.01)

(58) Field of Classification Search

CPC ..... F04D 25/08; F04D 25/14; F04D 27/002; F04D 19/002; F04D 29/325; F04D 29/522; F04D 29/563

USPC ..... 415/14, 26, 34, 36, 42, 46, 48–49, 146

See application file for complete search history.

(56) References Cited

U.S. PATENT DOCUMENTS

| | | | | |
|---|---|---|---|---|
| 1,294,910 | A * | 2/1919 | Valentine | F03D 7/02 361/237 |
| 2,548,607 | A * | 4/1951 | Jenn | F04D 25/14 454/350 |
| 2,934,084 | A | 4/1960 | Adams | |
| 3,159,334 | A | 12/1964 | Hull | |
| 3,771,927 | A * | 11/1973 | Schiller | F04D 15/0027 415/131 |
| 4,964,422 | A | 10/1990 | Ball et al. | |
| 5,827,044 | A * | 10/1998 | Yazici | F04D 29/4213 415/132 |
| 8,157,241 | B2 | 4/2012 | Swinford | |
| 8,613,198 | B2 | 12/2013 | Swinford | |
| 9,279,511 | B2 | 3/2016 | Bagge | |

FOREIGN PATENT DOCUMENTS

| | | |
|---|---|---|
| GB | 825120 | 12/1959 |

* cited by examiner

*Primary Examiner* — David E Sosnowski
*Assistant Examiner* — Maranatha Boardman
(74) *Attorney, Agent, or Firm* — McGarry Bair PC

(57) ABSTRACT

A fan with a housing defining an interior and a flow path therein and a valve assembly including a valve element disposed in the flow path and configured to rotate between an opened position and a closed position, wherein the valve element closes the flow path and a linkage assembly and a method of operating.

19 Claims, 8 Drawing Sheets

FAN WITH SHUT-OFF VALVE AND METHOD OF OPERATING

BACKGROUND OF THE INVENTION

In certain applications of a ducted or shrouded fan, including those in the field of avionics, it is required that the flow of air not reverse when the fan is at rest. To achieve this, a shut-off valve is introduced to close the air passage. A conventional method is to use a check valve having flappers that are moved through aerodynamic forces.

BRIEF DESCRIPTION OF THE INVENTION

In one aspect, the present disclosure relates to a fan including a housing defining an interior and a flow path therein, an impeller assembly slidably located within the interior and having a set of blades where the impeller is rotatable about an axis of rotation, and a valve assembly including a valve element disposed in the flow path and operably coupled to the impeller assembly and configured to rotate between an opened position and a closed position where the valve element closes the flow path, and a linkage assembly physically coupling the impeller assembly and the valve element wherein the valve element is configured to rotate between the open and closed positions based on slidable movement of the impeller assembly.

In another aspect, the present disclosure relates to a valve assembly for a fan having a housing defining a flow path, comprising a fan configured to provide a linear driving force, a valve element rotatably mounted to the housing and disposed in the flow path and operably coupled to the fan and configured to rotate between an opened position and a closed position where the valve element closes the flow path, and a linkage assembly physically coupling the fan and the valve element wherein the linkage assembly is configured to translate the linear driving force into rotational motion of the valve element such that the valve element rotates between the opened position and closed position based on the linear driving force provided by the fan.

In yet another aspect, the present disclosure relates to a method of operating a fan shut-off valve, the method comprising operating an impeller to generate a thrust force that linearly moves at least a portion of the fan shut-off valve and translating linear movement of the at least a portion of the fan shut-off valve into rotational movement of a plate portion of the valve to rotate the plate portion from a closed position to an opened position.

DESCRIPTION OF EMBODIMENTS OF THE INVENTION

Figure 1A:
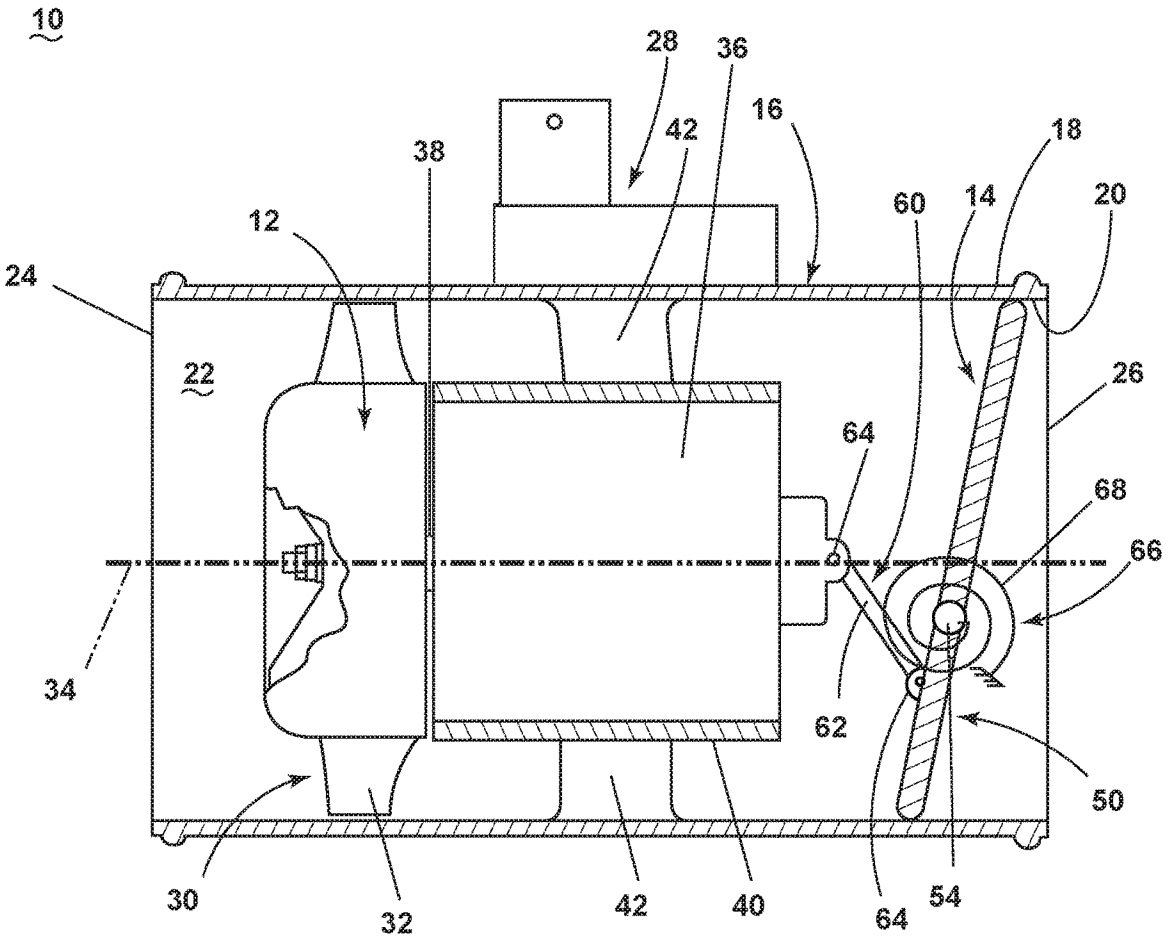
FIG. 1A is a schematic cutaway side view of a fan assembly.

Aspects of the disclosure described herein relate to a shut-off valve for a fan or air duct fluid coupled to a fan. FIG. 1 illustrates an exemplary embodiment wherein a fan assembly 10 includes a fan 12, valve assembly 14, and housing 16. This figure illustrates the fan assembly 10 at rest with the valve assembly 14 in its default, closed, position. By way of non-limiting example, a cylindrical duct 18 can form the housing 16 and define an interior 20 and a flow path 22 therein between a housing inlet 24 and a housing outlet 26. An electrical connector 28 for the fan assembly 10 is also illustrated for exemplary purposes. Such an electrical connector can be operably coupled to a controller (not shown) or electricity source (not shown).

The fan 12 is at least partially located within the housing 16 and includes an impeller assembly 30 slidably located within the interior 20 and having a set of blades 32. The set of blades 32 are rotatable about an axis of rotation 34. In the illustrated example, the axis of rotation 34 also defines the centerline within the housing 16. A motor 36 is also included in the impeller assembly 30 and includes an output shaft 38 drivingly coupled to the set of blades 32.

It is contemplated that the impeller assembly 30 is slidably located within the interior 20. For example, a rail 40 can be included within the interior 20 of the housing 16 and the motor 36 can be slidably mounted onto or within such a rail 40. In the illustrated example, the rail 40 includes a cylindrical tube within which at least a portion of the motor 36 is located. In the illustrated example, the rail 40 can be formed as a part of the housing 16 and held therein via multiple radial vanes 42.

A valve element 50 of the valve assembly 14 is substantially centrally disposed within the housing 16 and located within the flow path 22. The valve element 50 can be any suitable valve element including a butterfly valve element having a plate 52. The plate 52 can conform to the shape of the housing 16 so as to seal or close off the flow path 22 when the valve element is in a closed position. The plate 52 is operably coupled to a shaft 54 held within or otherwise mounted to the housing 16. The shaft 54 can be integrally formed with the plate 52 or otherwise mounted thereto. The housing 16 or plate 52 can integrally include mounting features or such mounting features can be separately formed. Regardless, the valve element 50 is integrated in the housing 16 and configured to rotate between an opened position (FIG. 2B) and a closed position (FIG. 1B) where the valve element 50 closes the flow path 22.

It is contemplated that the plate 52 has an area substantially the same as the cross sectional area of the flow path 22 formed by the cylindrical duct 18. When the valve element 50 is in the closed position it can contact the inner surface of the cylindrical duct 18. It is contemplated that a seat or seal can be included within the cylindrical duct 18 such that the valve element 50 can rest against such a seat or seal when the valve element 50 is in the closed position. Regardless of whether a seat or seal is included, it is contemplated that the valve element 50 can completely close or otherwise seal the cylindrical duct 18 as illustrated in FIG. 1B. When the valve element 50 is in the opened position (FIG. 2A) the plate 52 rotates such that fluid may pass through the flow path 22 defined by the cylindrical duct 18.

Further still, a linkage assembly 60 can be included and configured to physically couple the laterally slidable impeller assembly 30 and the valve element 50. In the illustrated example, the linkage assembly 60 includes a bar 62 operably coupled to the impeller assembly 30 and the valve element 50. More specifically, eyes 64 have been illustrated as being operably coupled to or otherwise included in the motor 36 and the plate 52. The bar 62 links to the eyes 64 at either of its ends and thus operably couples the impeller assembly 30 and the valve element 50. While not illustrated for clarity, it will be understood that the bar 62 can be operably coupled to the eyes 64 in any suitable manner, including that the bar 62 can include eyes on each end. It will be understood that the linkage assembly can be an alternative mechanical linkage.

As the fan assembly 10 is often subject to vibrations, a biasing element 66 can be included to bias the valve element 50 to the closed position. In the illustrated example of FIG. 1A, a spring 68 is operably coupled to the shaft 54 and configured to bias the plate 52 towards the closed position. The spring 68 can include, but is not limited to, a torsion spring or coil spring operably coupled to the shaft 54 of the valve element 50. In the illustrated example, the spring 68 is located exterior to the housing 16. In FIG. 1B, the spring 68 is schematically illustrated as a rectangle for clarity. FIG. 1B illustrates that the shaft 54 of the valve element 50 is engaged with the spring 68, which is placed in its own housing 70.

Figure 2A:
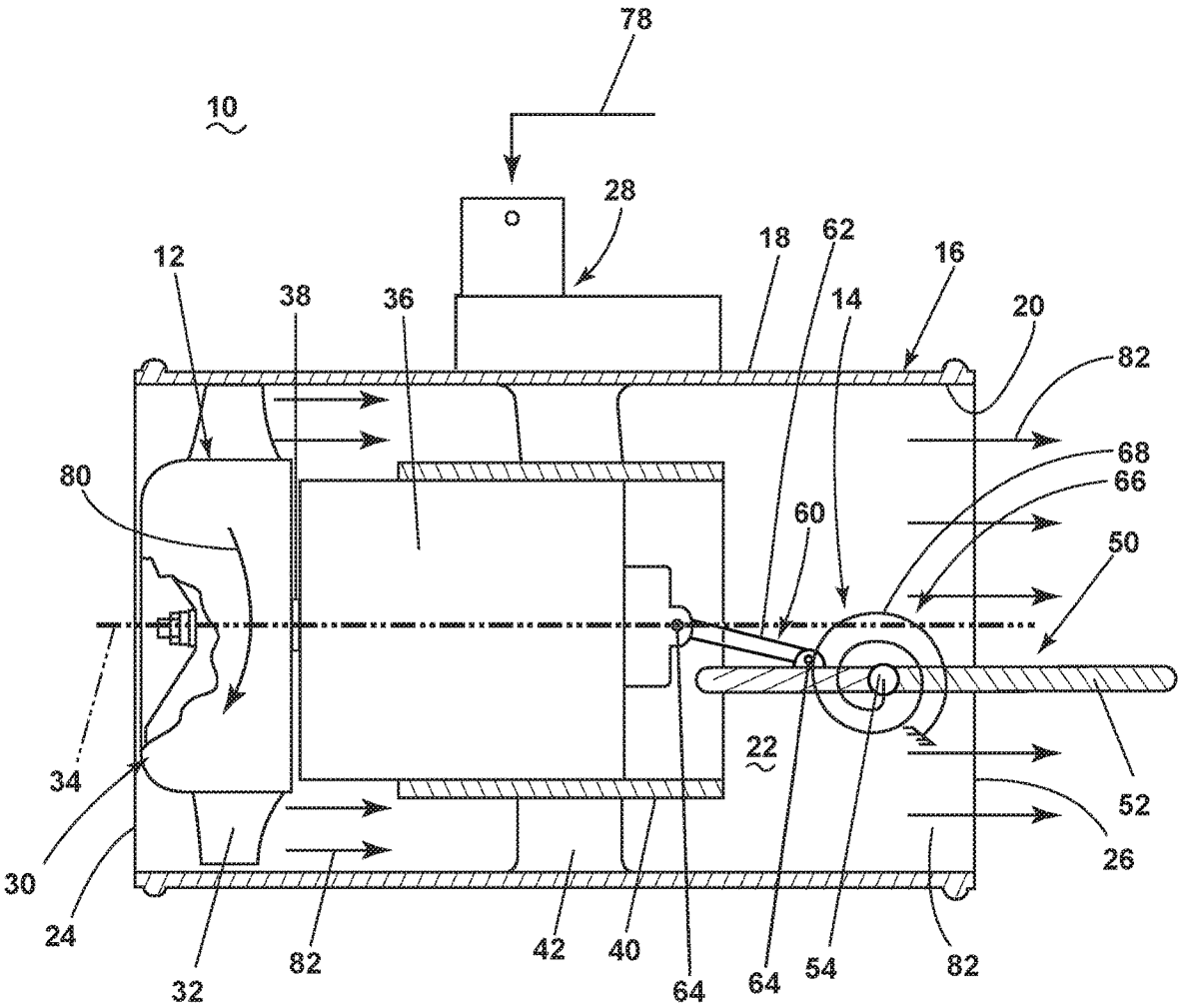
FIG. 2A is a schematic cutaway side view of the fan assembly of FIG. 1A during operation of the impeller.
Figure 2B:
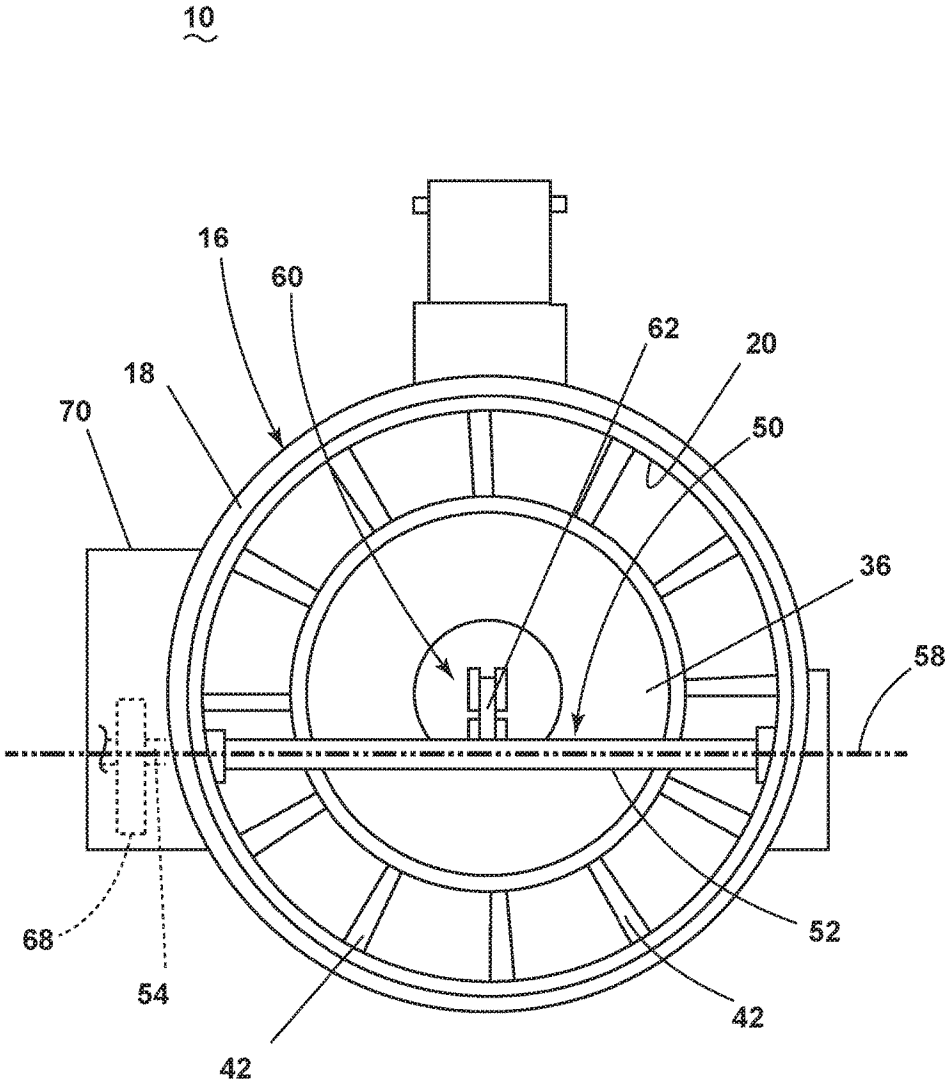
FIG. 2B is an end view of the fan assembly of FIG. 2A.

During operation, when the motor 36 of the fan assembly 10 is energized, the set of blades 32 rotate and thrust is generated as a reaction. Referring now to FIG. 2A, power or a control signal is schematically illustrated as arrow 78 and the rotating of the set of blades 32 is indicated by the arrow 80. This figure illustrates the fan assembly 10 during operation with the valve assembly 14 in its opened position. Note the different location of the impeller assembly 30 including the motor 36. By way of non-limiting example, airflow along the flow path 22 is illustrated with arrows 82.

Figure 4:
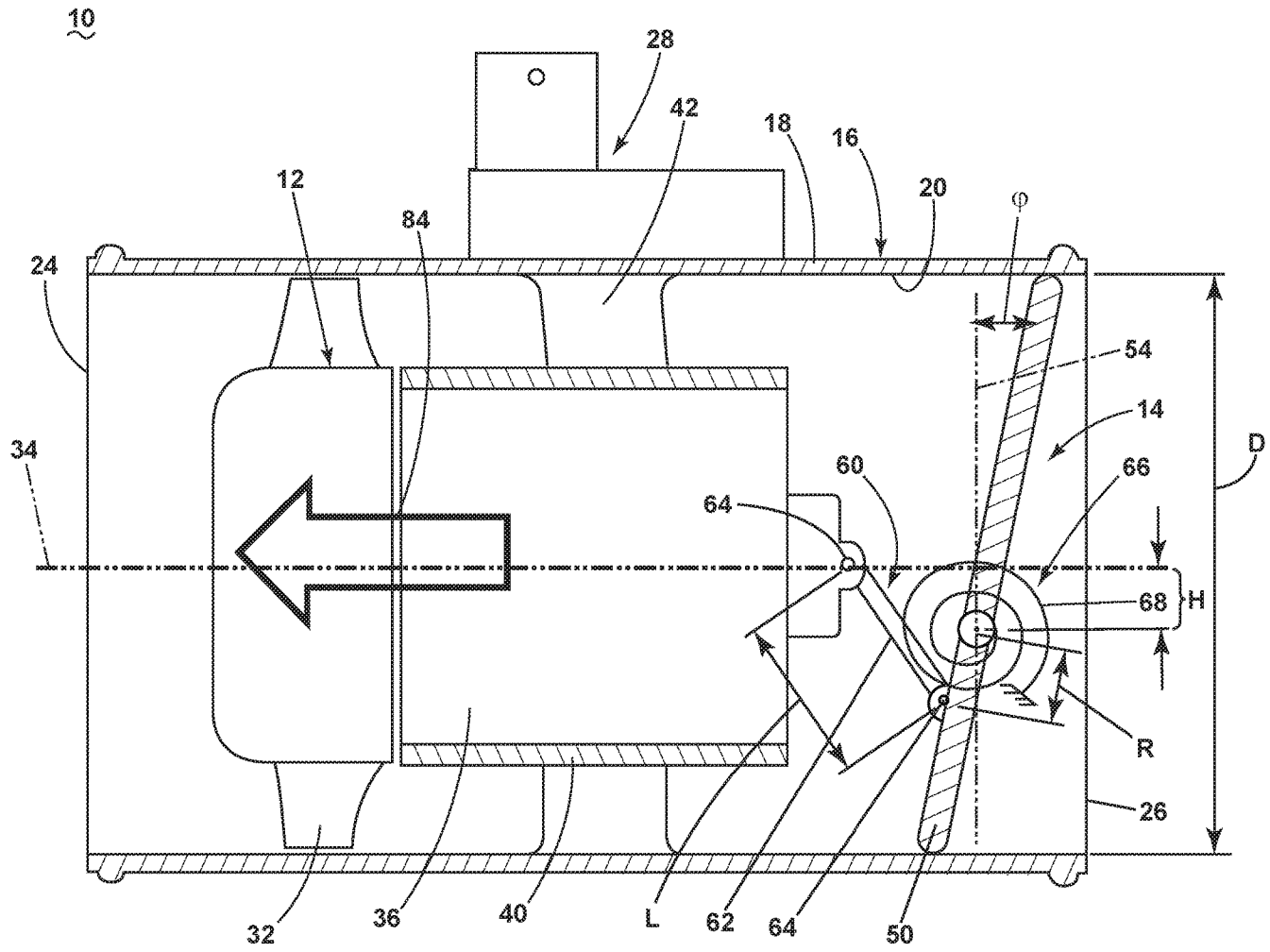
FIG. 4 is a schematic view of the fan assembly of FIG. 1A.

Thrust is generated as a reaction from the air stream as the air flows from left to right, in the illustration. This pushes the impeller assembly 30, including the motor 36, laterally along a portion of the housing 16. More specifically, the impeller assembly 30 is moved forward, to the left as illustrated by arrow 84 (FIG. 4). Accordingly, the bar 62 is pulled forward, to the left in the illustration, and this action creates a turning moment about the axis of rotation 58 defined by the shaft 54 of the valve element 50 to turn the plate 52 to the opened position. In other words, the linkage assembly 60 pulls on the valve element 50 and the valve element 50 rotates towards the opened position. In this manner, the linkage assembly 60 and the illustrated bar 62 is configured to translate the linear driving force into rotational movement of the plate 52. Correspondingly, the valve element 50 rotates between the closed position (FIG. 1A) and opened position (FIG. 2A), where the flow path 22 is opened based on the linear driving force. The plate 52 is moved into a completely opened position so distraction to airflow is minimal.

Figure 1B:
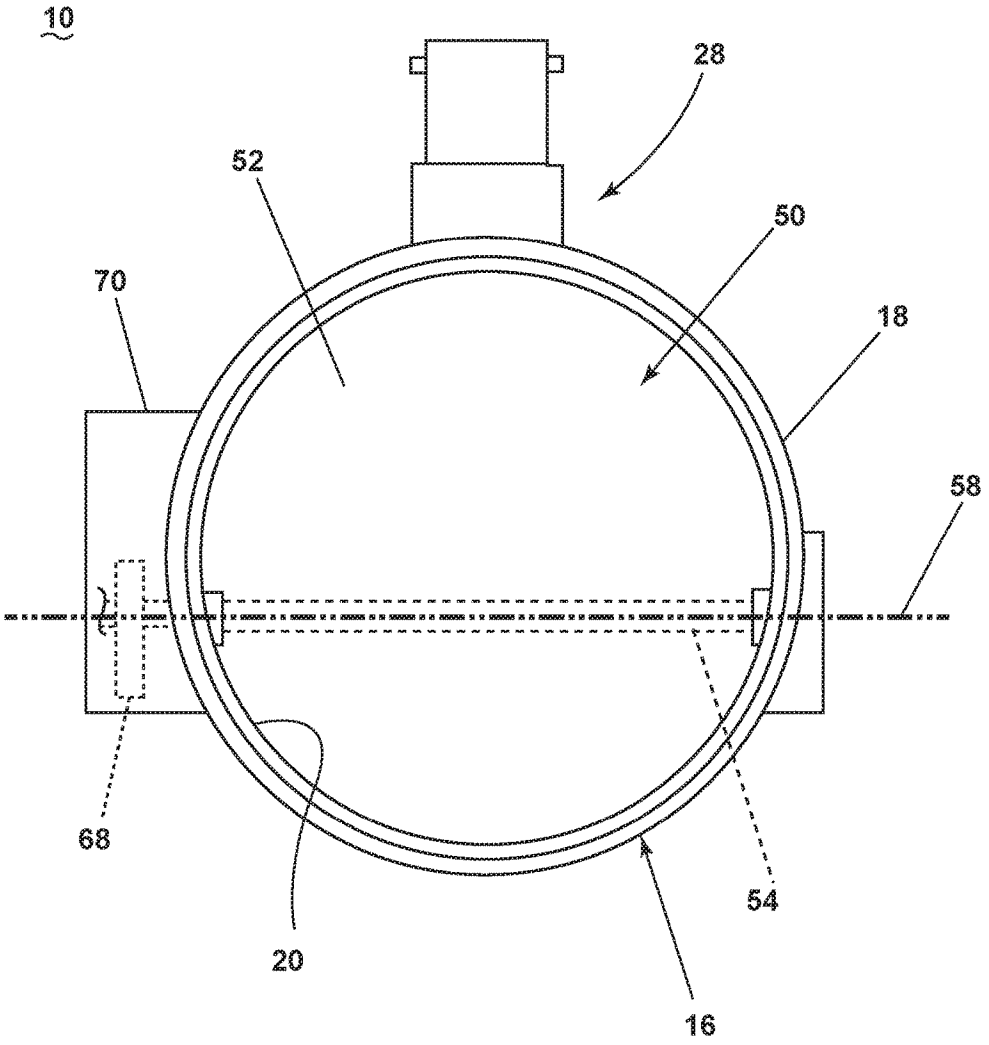
FIG. 1B is an end view of the fan assembly of FIG. 1A.

Conversely, when the fan 12 stops, the spring 68 unwinds and brings the valve element 50 back to its default, closed, position (FIG. 1A). When the fan 12 stops, the spring 68 gradually unwinds and brings everything back to the default, closed, position.

The axis of rotation 58, defined by the shaft 54, of the plate 52, is offset within the interior 20 of the housing 16 and the axis of rotation 34 of the impeller assembly 30. The offset axis of the plate 52 helps the valve element 50 to completely open parallel to the flow of air through the housing 16, by preventing the turning moment from diminishing at the full opened position and ensures that the plate 52 stays there. If the axis of the plate were centered the valve may not fully open or may not stay fully open. The offset axis of rotation 58 also helps to open the valve element 50 more easily, thanks to the imbalance of surface area between the opposite sides of the shaft 54, which will create a turning moment by the flow pressure, and assists opening.

Figure 3:
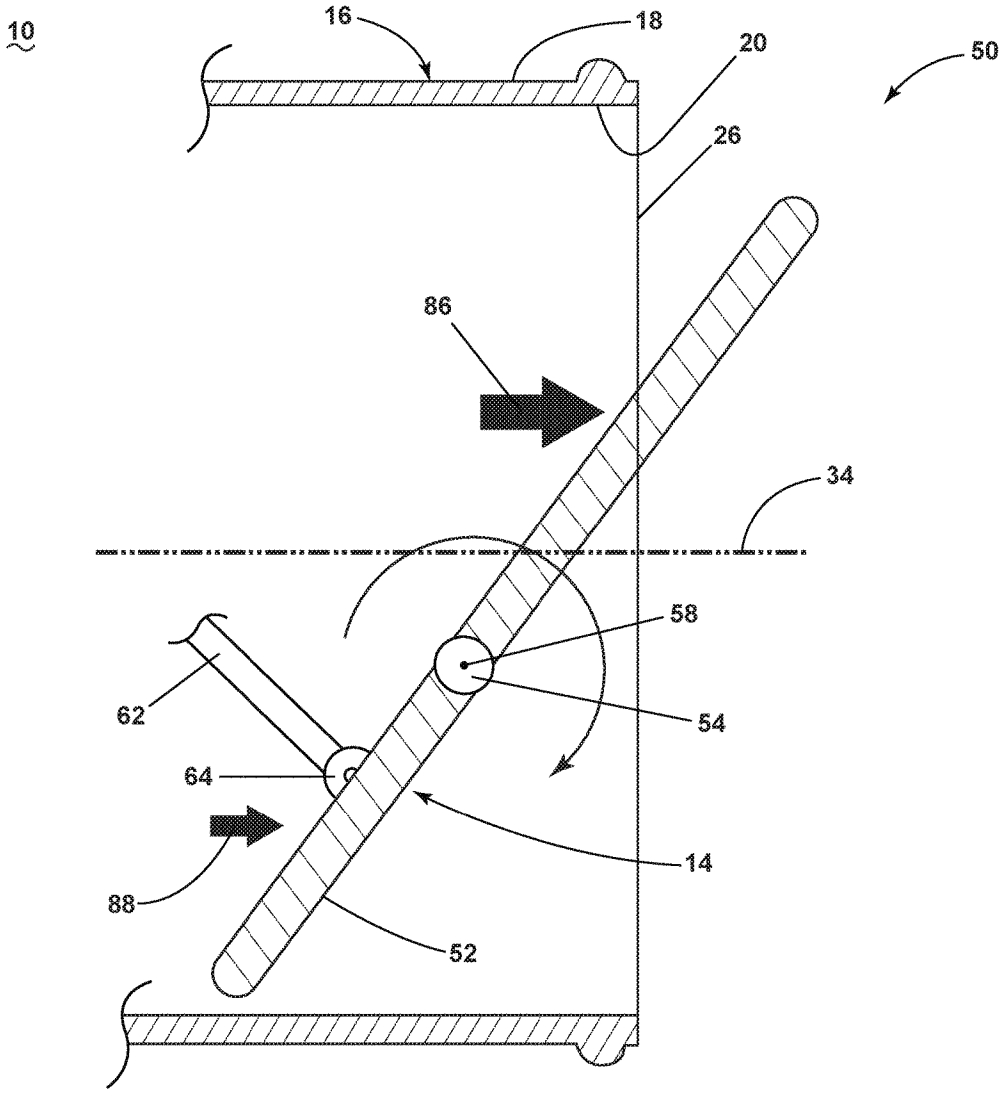
FIG. 3 is a schematic view of a portion of the valve assembly included in the fan assembly of FIG. 1A.

As illustrated more clearly in FIG. 3, during operation, there is a higher dynamic force due to airflow on the larger upper surface area of the plate 52 defined by the shaft 54. The higher dynamic force is shown schematically with arrow 86. Conversely, there is a lower dynamic force due to airflow on the smaller lower surface area of the plate 52, shown schematically with arrow 88. Such an imbalance creates more turning moments on the valve element 50. The same mechanism also works when the fan assembly 10 is at rest and the valve element 50 is in the closed position. If there is backpressure, the imbalance of area works to create a moment in the opposite direction.

Figure 5:
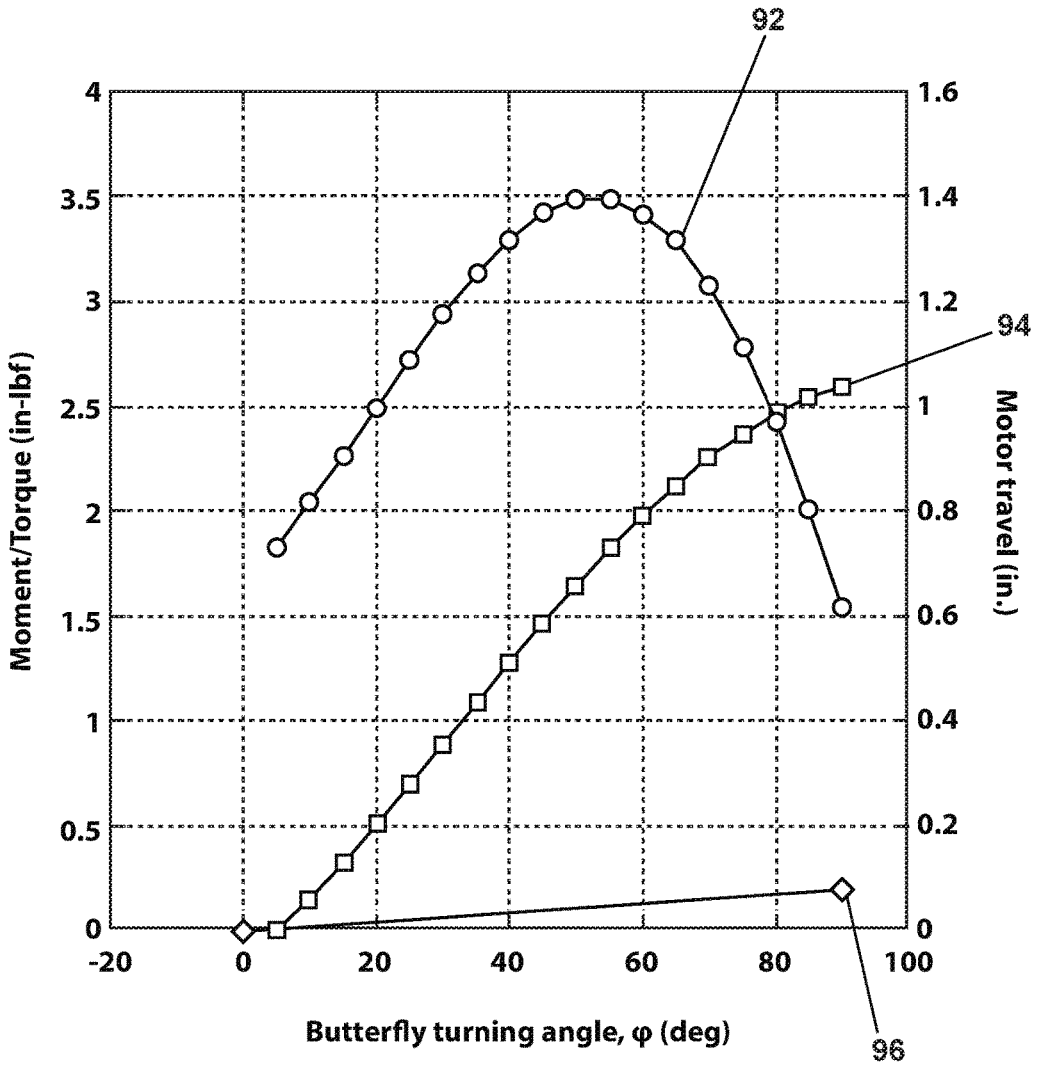
FIG. 5 is a plot graph showing valve turning moment versus restoring torque in an exemplary fan assembly.

It will be understood that the travel distance of the motor 36 within the housing 16 is set in such a way to correspond to the turning angle of the plate 52 between the closed and opened positions. FIG. 4 illustrates various geometric parameters for an exemplary fan assembly 10. Where D=12.7 centimeters (5.0 inches), where the pivot offset, H=1.27 centimeters (0.5 inches), R=1.5875 centimeters (0.625 inches), and L=3.556 centimeters (1.4 inches). It will be understood that the spring constant of the spring 68 is adjusted such that it is high enough to hold the plate 52 closed while the fan 12 is at rest, but soft enough to allow the motor 36 to slide under the thrust created by the impeller assembly 30. In the above example, it is contemplated that the fan thrust created is 0.0037 ton force (7.4 lbf). FIG. 5 shows a plot graph that illustrates exemplary valve element turning angles (φ) versus motor travel distance and restoring torque due to the spring 68. Plot 92 illustrates the turning moment on the plate 52 by fan thrust, 94 illustrates the motor travel, and 96 illustrates the restoring torque by the spring 68. It has been found that there is sufficient turning moment at any valve opening angle, which will guarantee that the plate 52 reaches the fully opened position.

Figure 6:
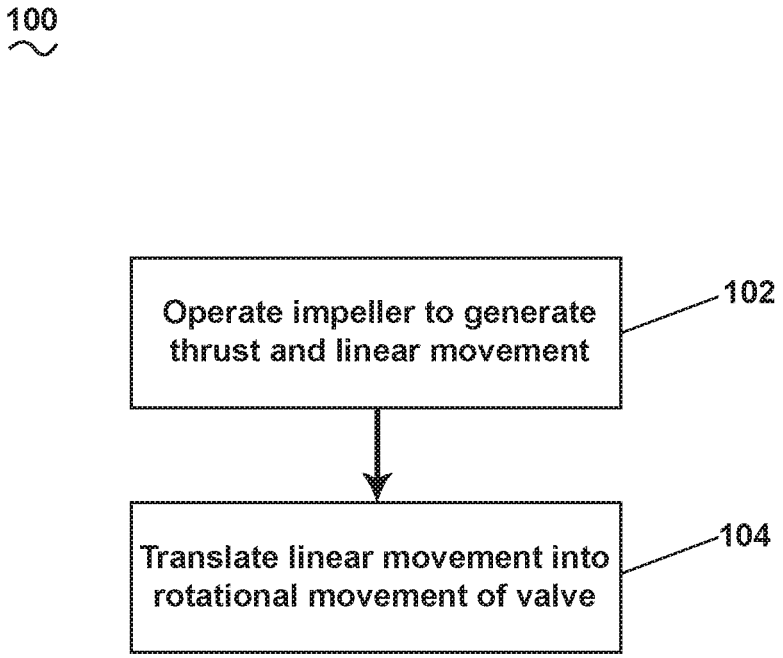
FIG. 6 is a flowchart showing a method of operating a fan assembly according to aspects of the present disclosure.

In this manner, the previously described fan assembly 10 and valve assembly 14 can be used to implement one or more embodiments of a method. For example, FIG. 6 illustrates a flow chart of a method 100 of operating a fan check or shut-off valve such as included in the fan assembly 10. At 102, the method begins by operating an impeller assembly such as the impeller assembly 30 to generate a thrust force that linearly moves at least a portion of the fan shut-off valve or valve element 50. At 104, linear movement of at least a portion of the fan shut-off valve created by the thrust force is translated into rotational movement of a plate 52 of the valve element 50 to rotate the plate 52 from a closed position to an opened position. In the above illustrations such linear translation is accomplished via the linkage assembly 60.

The sequence described is for exemplary purposes only and is not meant to limit the method of operation in any way as it is understood that the portions of the method may proceed in a different logical order, additional or intervening portions may be included, or described portions of the method may be divided into multiple portions, without detracting the present disclosure. For example, the method 100 can include ceasing operation of the impeller assembly 30 to remove the thrust force from portion thereof. Further, a spring force such as from the biasing element 66 can be utilized to return the plate 52 to the closed position (FIG. 1A)

Conventionally, the operation of flapper check valves depended solely on aerodynamics or complicated gearing. For example, flappers have been pushed open by total pressure generated by a rotating impeller of the fan. In such conventional assemblies there is no guarantee that the flappers will fully open because at a certain opening angle of the flappers, aerodynamic forces to push them will come to equilibrium with the restoring moment of the spring, resulting in a partially opened state. This can lead to considerable pressure loss to the flow. To overcome this, the fan needs to be designed to generate higher pressure rise, which will translate into the need for a more powerful motor, and thus higher power consumption.

Aspects of the disclosure replace the flappers with a butterfly or plate valve element, and mechanically link it with the impeller-motor subassembly which is designed to slide axially, making use of thrust force generated by the rotating impeller. In this manner, the valve element is configured to rotate between the open and closed positions based on slidable movement of the impeller assembly. The aspects of the disclosure described herein provide for a variety of benefits including the described valving and mechanism solves the problem of possible adverse effect on the flow and higher power budget requirement of the motor associated with conventional valves. The aspects of the disclosure provide for minimal disruption to the flow of air, by ensuring full opening of the valve, which is in parallel to the flow. This in turn can save power to the motor and thus less power demand on the vehicle side. This in turn means that the motor can be smaller, which will save weight. Further, a smaller motor will cost less to manufacture. While the above specification discusses the aspects of the disclosure with respect to an avionics fan, it will be understood that the aspects of the disclosure can be utilized in any valve assembly utilizing impelled air including, but not limited to, in alternative vehicles such as cars and ships. Further still, aspects of the disclosure do not require a separate and external control mechanism for the valve and is therefore self-contained. A spring can be attached to the valve element for anti-rattling purposes.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fan, comprising:

a housing defining an interior and a flow path therein;

an impeller assembly including a motor, the impeller assembly slidably located within the interior and having a set of blades drivably coupled with an output shaft of the motor, wherein the set of blades of the impeller assembly is rotatable about an axis of rotation; and a valve assembly, comprising:

a valve element disposed in the flow path and operably coupled to the impeller assembly and configured to rotate between an opened position and a closed position, wherein the valve element closes the flow path; and a linkage assembly physically coupling the impeller assembly and the valve element;

wherein the valve element is configured to rotate between the open and closed positions based on slidable movement of the impeller assembly.

2. The fan of claim 1, wherein the housing further comprises a rail along which the motor is slidably mounted.

3. The fan of claim 2, wherein the rail comprises a cylindrical tube within which at least a portion of the motor is located.

4. The fan of claim 1, wherein the linkage assembly comprises a bar operably coupled to the impeller assembly and the valve element.

5. The fan of claim 1, wherein the valve element is a butterfly valve element comprising a plate and a shaft, wherein the shaft is rotatably mounted to the housing.

6. The fan of claim 5, further comprising a spring operably coupled to the butterfly valve element and configured to bias the butterfly valve element towards the closed position.

7. The fan of claim 6, wherein the spring is a torsion spring operably coupled to the shaft of the butterfly valve element.

8. The fan of claim 7, wherein the spring is located exterior to the housing.

9. The fan of claim 5, wherein the axis of rotation of the plate is offset from the axis of rotation of the impeller assembly.

10. A valve assembly for a fan having a housing defining a flow path, comprising:

a valve element rotatably mounted to the housing and disposed in the flow path and operably coupled to the fan having a motor slidably located within the interior and having an output shaft drivingly coupled to the fan, the valve element configured to rotate between an opened position and a closed position, wherein the valve element closes the flow path; and a linkage assembly physically coupling a linearly moveable portion of the fan and the valve element;

wherein the linkage assembly is configured to translate linear driving force provided by a linearly moveable portion of the fan into rotational motion of the valve element such that the valve element rotates between the opened position and closed position based on the linear driving force.

11. The valve assembly of claim 10, wherein the valve element is a butterfly valve element comprising a plate and a shaft, wherein the shaft is rotatably mounted to the housing.

12. The valve assembly of claim 11, wherein the linkage assembly comprises a bar configured to translate the linear driving force into rotational movement of the plate.

13. The valve assembly of claim 11, further comprising a spring operably coupled to the butterfly valve element and configured to bias the butterfly valve element towards the closed position.

14. The valve assembly of claim 13, wherein the spring is a torsion spring operably coupled to the shaft of the butterfly valve element.

15. The valve assembly of claim 13, wherein the spring is located exterior to the housing.

16. The valve assembly of claim 11, wherein an axis of rotation of the plate is offset relative to a centerline of the housing.

17. A method of operating a fan assembly, the method comprising:

operating an impeller by way of a motor slidably located within a housing of the fan assembly, the motor having an output shaft driving coupled to the impeller to generate a thrust force that linearly moves at least a portion of the fan assembly; and translating linear movement of the at least a portion of the fan assembly into rotational movement of a plate portion of a valve to rotate the plate portion from a closed position to an opened position.

18. The method of claim 17, further comprising ceasing operation of the impeller to remove the thrust force from the at least a portion of the fan assembly.

19. The method of claim 18, further comprising utilizing a spring force to return the plate portion to the closed position.

* * * * *